US006978698B2

(12) United States Patent
Hofbrucker et al.

(10) Patent No.: US 6,978,698 B2
(45) Date of Patent: Dec. 27, 2005

(54) FASTENER GUIDE

(75) Inventors: Thomas Hofbrucker, Mammendorf (DE); Bernhard Liebert, Pfaffenhofen a.d. Glonn (DE); Markus Looser, Weilheim (DE); Manfred Ludwig, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 37 days.

(21) Appl. No.: 10/775,811

(22) Filed: Feb. 9, 2004

(65) Prior Publication Data

US 2004/0221686 A1 Nov. 11, 2004

(30) Foreign Application Priority Data

Feb. 7, 2003 (DE) ..... 103 05 043

(51) Int. Cl.[7] ..... B25B 23/06

(52) U.S. Cl. ..... 81/57.37; 81/433; 227/114; 227/127; 227/136; 227/139

(58) Field of Search ..... 81/57.37, 433, 81/434, 435; 227/107, 114, 115, 119, 127, 227/136, 139

(56) References Cited

U.S. PATENT DOCUMENTS

| | | | | |
|---|---|---|---|---|
| 2,255,827 | A | 9/1941 | Snyder | |
| 2,689,589 | A | 9/1954 | Allen et al. | |
| 3,907,014 | A * | 9/1975 | Manino | 81/433 |
| 4,630,766 | A * | 12/1986 | Steeves et al. | 227/136 |
| 4,674,367 | A | 6/1987 | Aab et al. | |
| 4,821,877 | A * | 4/1989 | Aab et al. | 81/57.37 |
| 4,932,580 | A * | 6/1990 | Pfister et al. | 227/136 |
| 5,144,870 | A * | 9/1992 | Nick | 81/434 |
| 5,897,045 | A * | 4/1999 | Olvera et al. | 227/119 |
| 6,189,759 | B1 * | 2/2001 | Canlas et al. | 227/120 |
| 6,296,167 | B1 * | 10/2001 | Jen | 227/120 |
| 6,431,428 | B1 * | 8/2002 | Chen | 227/120 |

* cited by examiner

*Primary Examiner*—Debra S Meislin
(74) *Attorney, Agent, or Firm*—Abelman, Frayne & Schwab

(57) ABSTRACT

A fastener guide (6) for use in a power-operated drive in device (4), particularly of a stand-up tool (2), having a guide path (16) in which a plurality of fasteners (14) can be received and which has a device-side opening (18) and a free opening (20), the guide path (16) being curved toward the device-side opening (18) proceeding from the free opening (20). The fastener guide (6) can be mounted on the drive in device (4) in a detachable manner by connection means, and the guide path (16) has a fall-out prevention device (26, 48) at each of the two openings (18, 20).

11 Claims, 7 Drawing Sheets

FASTENER GUIDE

BACKGROUND OF THE INVENTION

The invention is directed to a fastener guide for a power-operated drive-in device, particularly a stand-up tool, having a guide path in which a plurality of fasteners can be received and which has a side opening device and a free opening, the guide path being curved toward the side opening device proceeding from the free opening.

Stand-up tools are used primarily for mounting ground side workpieces or workpieces that can be walked upon such as flat roofs such that the person operating the tool can maintain a substantially upright posture while mounting. In known stand-up tools, the drive in device is filled with fasteners by magazine strips in which a supply of fasteners is stored. These magazine strips are usually attached to the fastener guide parallel to the working direction of the drive in device. Accordingly, the fasteners slide out of the magazine strip into the fastener guide of the drive in device which then guides them along its curvature to the drive in device.

DE 33 25 565 shows a magazine type screw gun with a magazine receptacle in which a magazine strip can be inserted and which can be closed by a locking cover. In the inserted state of the magazine strip, the fasteners slide out of the magazine strip into a curved screw guide which feeds the fasteners to a screwing tool.

An approach of the type mentioned above is disadvantageous since the screw magazine can be arranged at the drive in device only by a special receptacle device. This special receptacle device must be precisely adapted in size and shape to the screw magazine provided for filling. Therefore, the receptacle devices are relatively unwieldy and have a complicated construction. This can cause problems when filling the drive in device, especially under cramped conditions at the mounting location. An additional problem consists in that only screw magazines having a very particular size and shape may be inserted into the receptacles.

SUMMARY OF THE INVENTION

It is the object of the present invention to provide a fastener guide which overcomes the disadvantages mentioned above and ensures fast filling of a power-operated drive in device.

According to the invention, this object is met in that the fastener guide has connection means such as quick-connection means of a toolless connection, in the form of a catch connection or snap-on connection or quarter-turn closure, to which the drive in device can be fastened to be detachable, and the guide path has a fall-out prevention device at each of the two openings.

As a result, the fastener guide can be removed from the drive in device and stand-up tool for more convenient filling. The fall-out prevention devices prevent fasteners, e.g., screws or bolts, that are still contained in the fastener guide from falling out at the opening in an unwanted manner when the fastener guide is removed from the drive in device.

It is advantageous that at least one of the fall-out prevention devices has a blocking element which projects into the guide path in a closed position of the fall-out prevention device such that the guide path is blocked. An economical yet reliable means for preventing fasteners from falling out can thus be ensured.

The blocking element of the fall-out prevention device at the opening on the device side is preferably moved out of the guide path when the fastener guide is mounted on the drive-n device and therefore assumes an open position. In this way, it is ensured that the fasteners reach the drive in device without hindrance when the fastener guide is mounted at the drive in device.

In a particularly advantageous construction, the fastener guide has a magazine strip opening device at one of the openings. This magazine strip opening device at the fastener guide obviates the need for a receptacle for magazine strips at the drive in device. Instead, the fastener guide can be constructed such that the drive in device with the fastener guide attached thereto is compact and is thus easy to handle. Filling with fasteners can be carried out, as before, with conventional magazine strips, however, these magazine strips are no longer fastened to the drive in device but rather are opened by the magazine strip opening device and deliver their fasteners into the fastener guide. The fastener guide may be filled either when mounted on the drive in device or when detached from the drive in device.

The magazine strip opening device preferably has a deflecting device. The deflecting device projects into a magazine strip receptacle in which a magazine strip can be introduced. When the magazine strip is inserted into the magazine strip receptacle, at least one wall of the magazine strip is at least partially bent or deflected away from the rest of the magazine strips by the deflecting device. This arrangement ensures a reliable and fast opening of the magazine strip and a simple filling of the fastener guide.

In a preferred embodiment, the fall-out prevention device of the opening at which the magazine strip opening device is arranged has a spring arm. This spring arm swivels through the deflected wall. In this way, an opening of the magazine strip and a simultaneous unlocking of the fall-out prevention device can be achieved in a simple manner such that production costs can be kept relatively low.

The deflecting device advantageously has at least two inclined areas which are inclined away from the magazine strip receptacle in an insertion direction of the magazine strip and face in a direction of an inner side of the spring arm to ensure a simple and reliable displacement of the fall-out prevention device into an open position.

Further, it is advantageous when the blocking element is shaped at the inner side of the spring arm and has a sloping contact surface in a direction of the magazine strip receptacle. The sloping contact surface enables a uniform adjustment of the fall-out prevention device through the end of the wall of the magazine strip and accordingly makes it possible to open the guide path without interference from the magazine strip.

The magazine strip opening device is preferably arranged at the free opening such that the fastener guide can also be filled when connected to the drive in device.

Further, the above-stated object is met by a power-operated drive in device with a fastener guide, wherein the power-operated drive-in device has connection means which are shaped to complement the connection means of the fastener guide.

It is advantageous that the spring arm of the fall-out prevention device has an actuating element at the opening on the device-side. When the fastener guide is mounted, a deflecting element formed at the drive in device presses against the actuating element. In this way, the spring arm is swiveled and the blocking element moves out of the guide path. Accordingly, a fall-out prevention device is also provided at the opening of the guide path on the device side, which fall-out prevention device can be opened by deflecting elements which are formed at the drive in device in a very simple manner, e.g., exposed areas or recesses with inclined surfaces formed thereon. Manufacturing costs can be further minimized in this way.

BRIEF DESCRIPTION OF THE DRAWINGS

The invention will be described more fully in the following with reference to the following drawings, wherein.

DETAILED DESCRIPTION OF THE INVENTION

Figure 1:
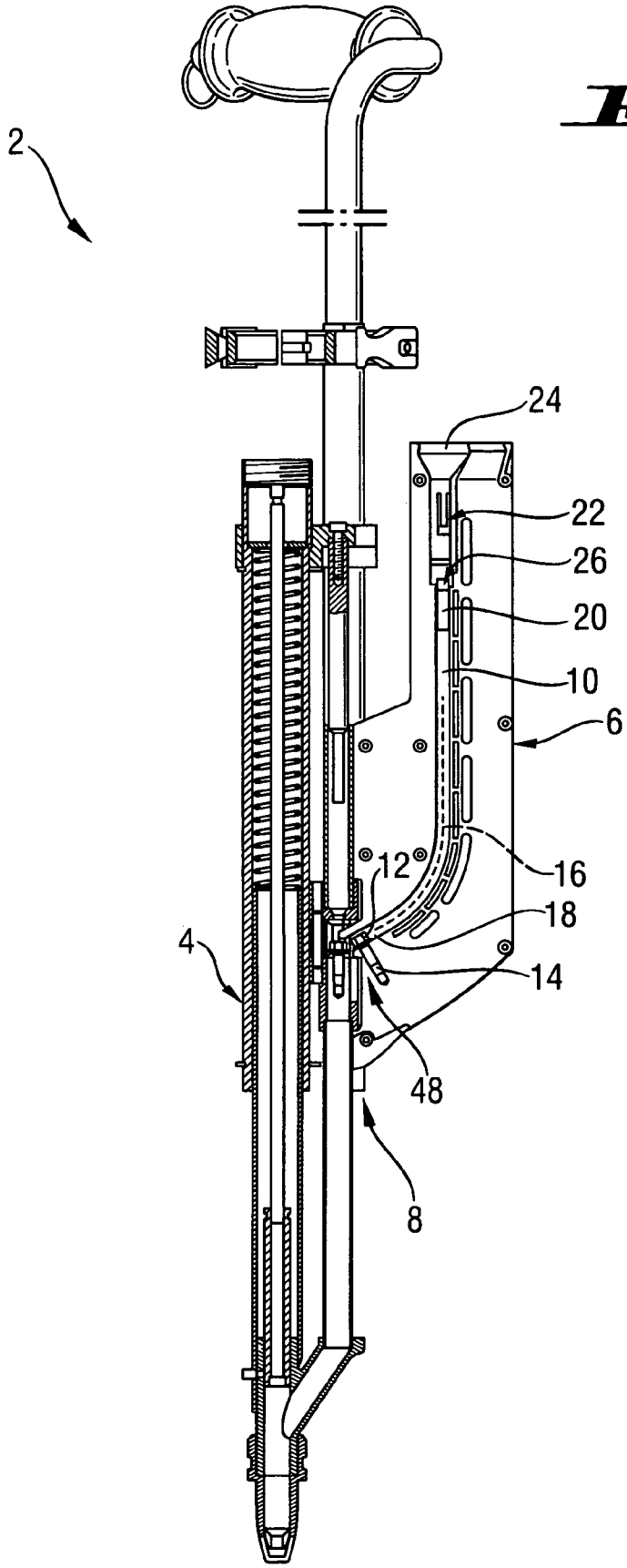
FIG. 1 shows a sectional view of an entire stand-up tool with a fastener guide according to the invention.
Figure 2:
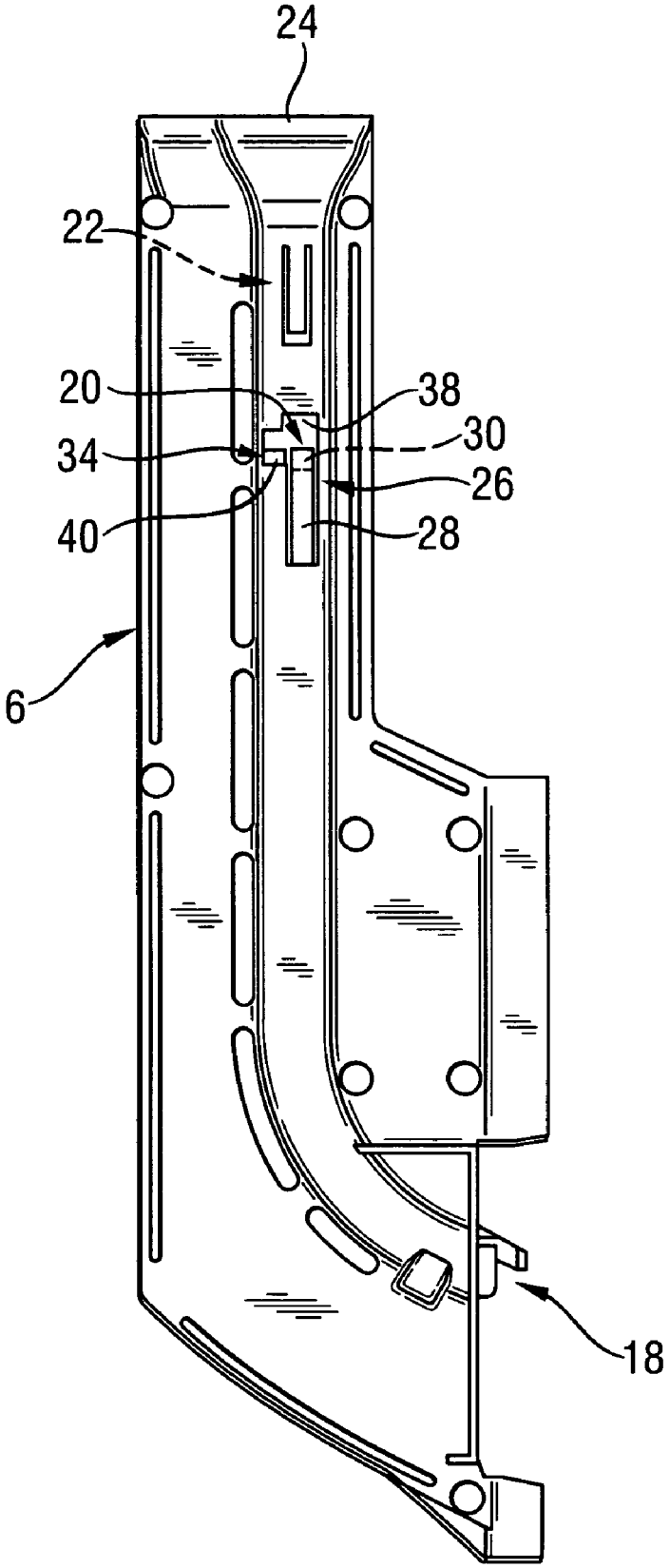
FIG. 2 shows a view of the fastener guide of FIG. 1.

FIG. 1 shows a stand-up tool 2 which has a power-operated drive in device 4 at which a fastener guide 6 is arranged. The drive in device 4 and the fastener guide 6 are detachably connected to one another by a connection area 8 at which the drive in device 4 and the fastener guide 6 have connection means, a toolless quick-connection device in the form of a snap-on device.

The fastener guide 6 has a guide 10 in which heads 12 of fasteners 14 such as screws or bolts can be held in a displaceable manner. The space traversed by the fasteners 14 when displaced along the guide 10 will be referred to as the guide path 16.

The guide path 16 has an opening 18 on the device side and a free opening 20. A magazine strip receptacle 22 having a funnel-shaped receiving opening 24 adjoins this free opening 20.

As can be seen particularly from FIGS. 2 to 5, a first fall-out prevention device 26 having a first spring arm 28 connected at one end to the fastener guide 6 is provided at the free opening 20 of the guide path 16. At its movable end, the first spring arm 28 has a first nose-shaped blocking element 30. This first blocking element 30 forms a sloping contact surface 32 in a direction of the magazine strip receptacle 22. In the unloaded state of the first spring arm 28, the first blocking element 30 projects into the guide path 16 and accordingly blocks the guide path 16 in a direction of the receiving opening 24. This prevents fasteners 14 arranged in the guide path 16 of the fastener guide 6 from slipping out of the receiving opening 24 in an unwanted manner.

Further, a magazine strip opening device 34 is arranged at the free opening 26 of the guide path 16. This magazine strip opening device 34 comprises a tooth-shaped deflecting device 36 which is formed at the wall opening 38 of the fastener guide 6 and has an inclined portion 40 which projects into the magazine strip receptacle 22 and is directed outward away from the magazine strip receptacle 22 in a direction of the first blocking element 30.

Figure 3:
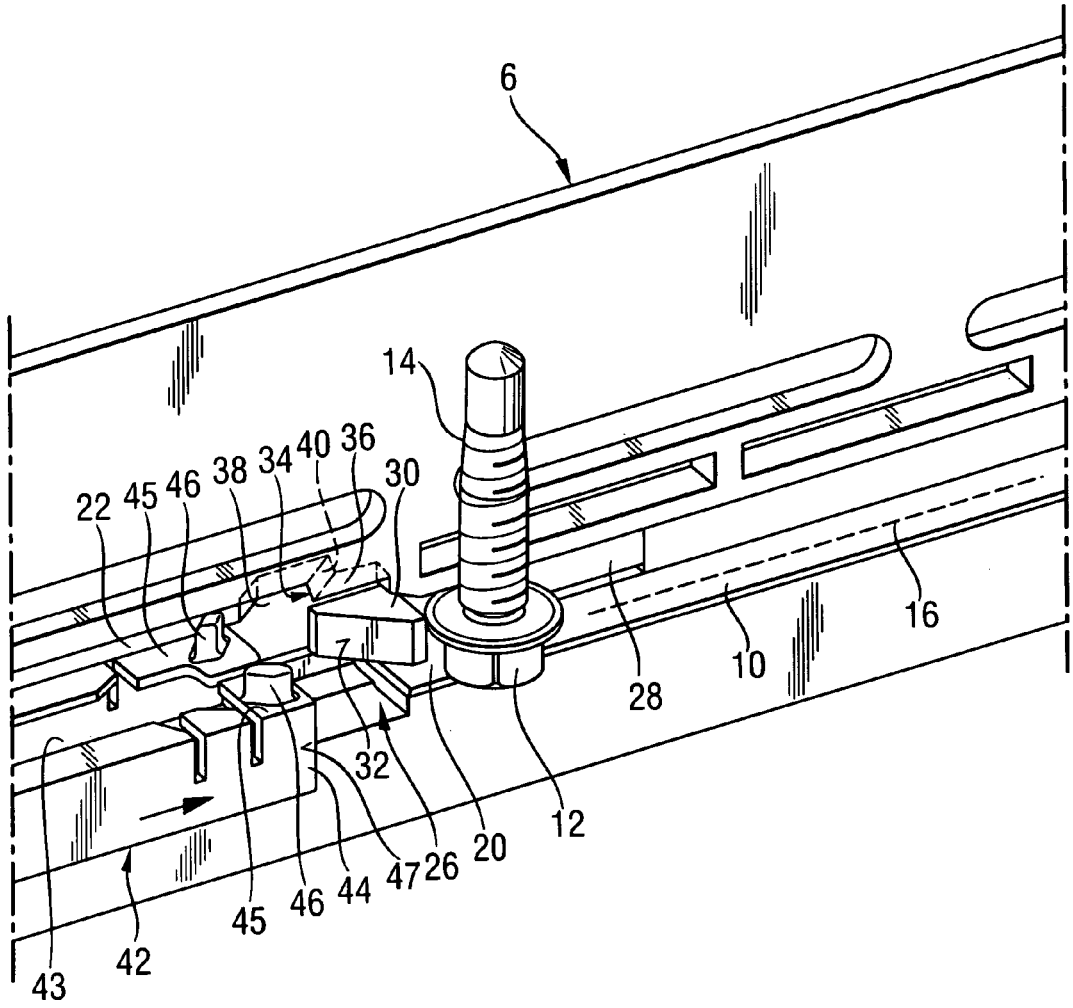
FIG. 3 shows a section of an inner side of the fastener guide with a blocking element in the closed position and a closed magazine strip end according to the invention.
Figure 4:
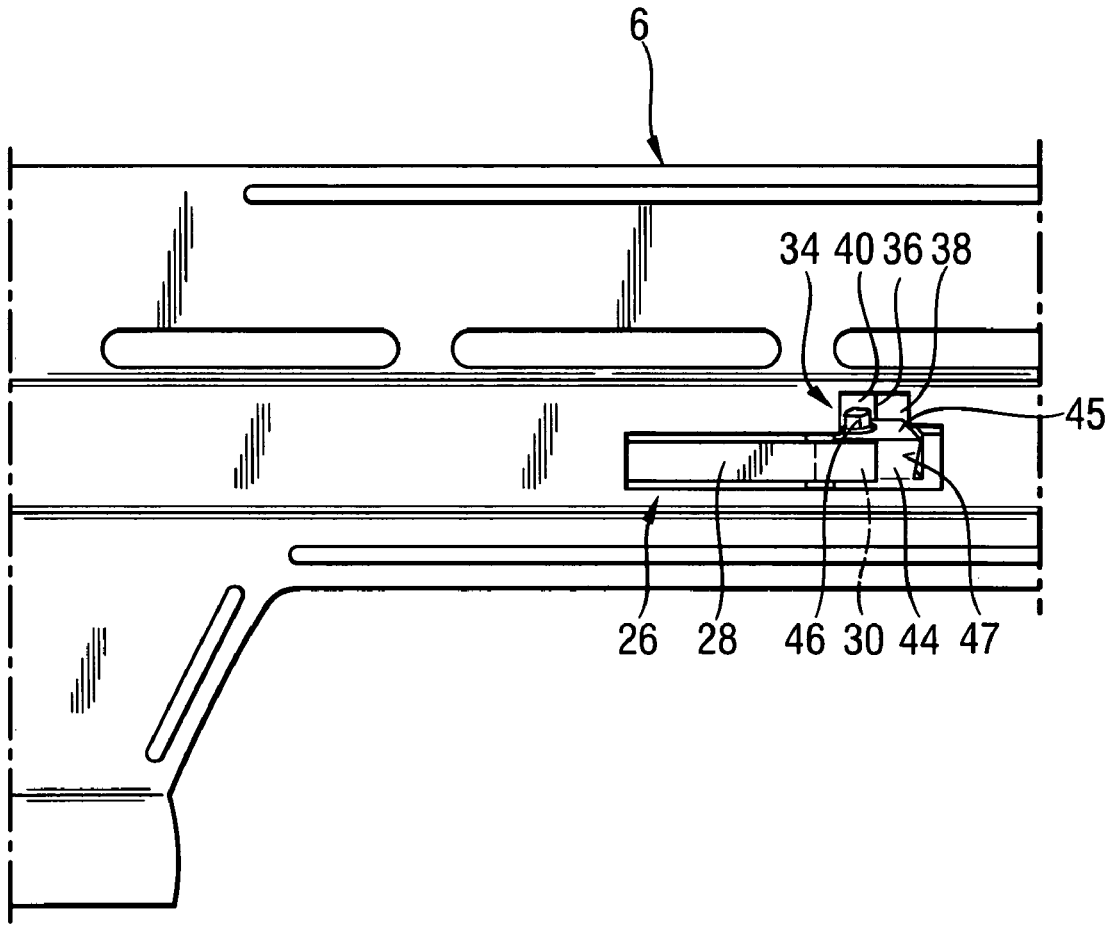
FIG. 4 shows a section of an outer side of the fastener guide with a blocking element in the open position and an opened magazine strip end according to the invention.
Figure 5:
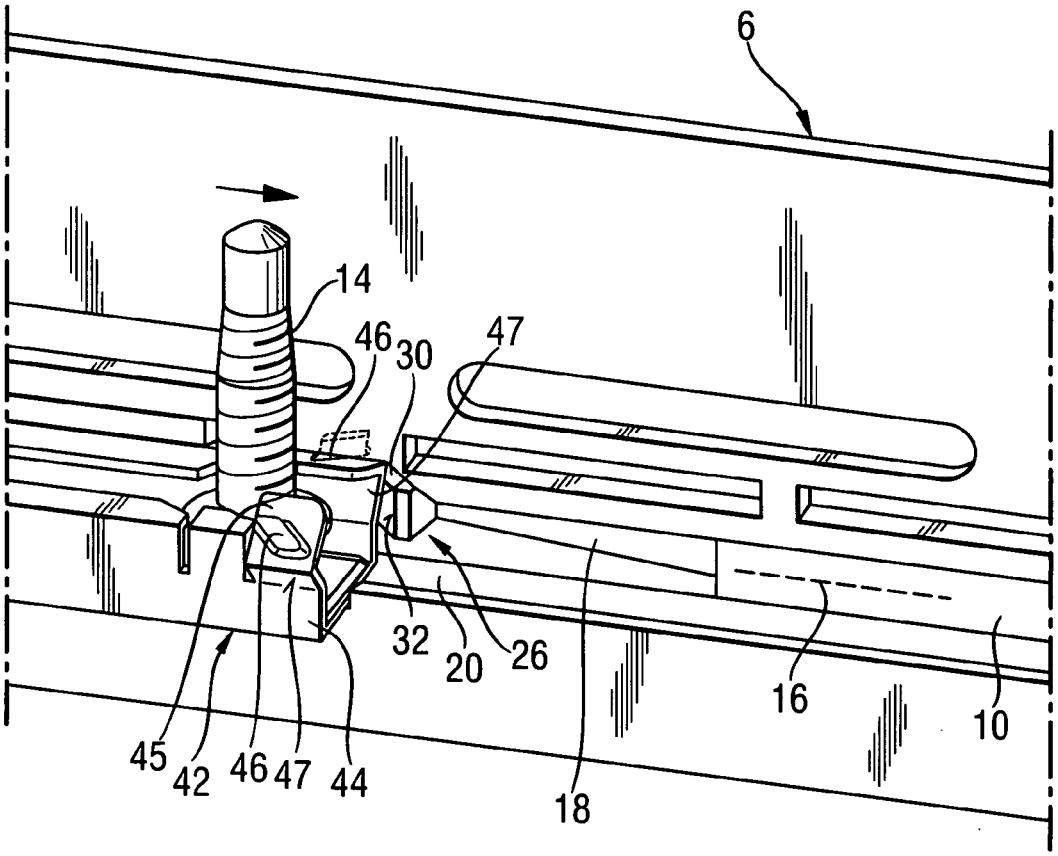
FIG. 5 shows a section of an inner side of the fastener guide with a blocking element in the open position and an open magazine strip end according to the invention.

FIGS. 3 to 5 show how the fastener guide 6 is filled by a magazine strip 42, which is pushed into the magazine strip receptacle 22 through the funnel-shaped receptacle opening 24.

FIG. 3 shows the initial position with a closed first fall-out prevention device 26 by which a fastener 14 that is already guided in the guide path 16 is blocked in a direction of the magazine strip receptacle 22 by the first blocking element. The magazine strip 42 projects into the magazine strip receptacle 22 and has a front end area 44 in which a receptacle cross section 43 of the magazine strip 42 is narrowed such that fastener heads (not shown) that are held in the receptacle cross section can not slip out of the magazine strip in an unwanted manner. A deflecting body 46 which projects upward from the end area 44 is formed at two upper walls 45, respectively.

When the magazine strip 42 is displaced farther into the magazine strip receptacle 22, the deflecting body 46 comes into contact with the inclined portion 40 of the deflecting device 36 (see FIG. 4). The deflecting body 46 is moved along the inclined portion 40 out of the wall opening 38 and the lateral wall 47 is simultaneously bent in the direction of the sloping contact surface 32 of the first blocking element 30 and presses the latter out of the guide path 16.

In this way, both the end area 44 of the magazine strip 42 and the first fall-out prevention device 26 are opened. As is shown in FIG. 5, it is now possible for fasteners 14 to slide into the guide path 16 of the fastener guide 6 from the magazine strip 42 via the open end area 44 past the first blocking element 30, which is now positioned outside of the guide path 16.

Figure 6:
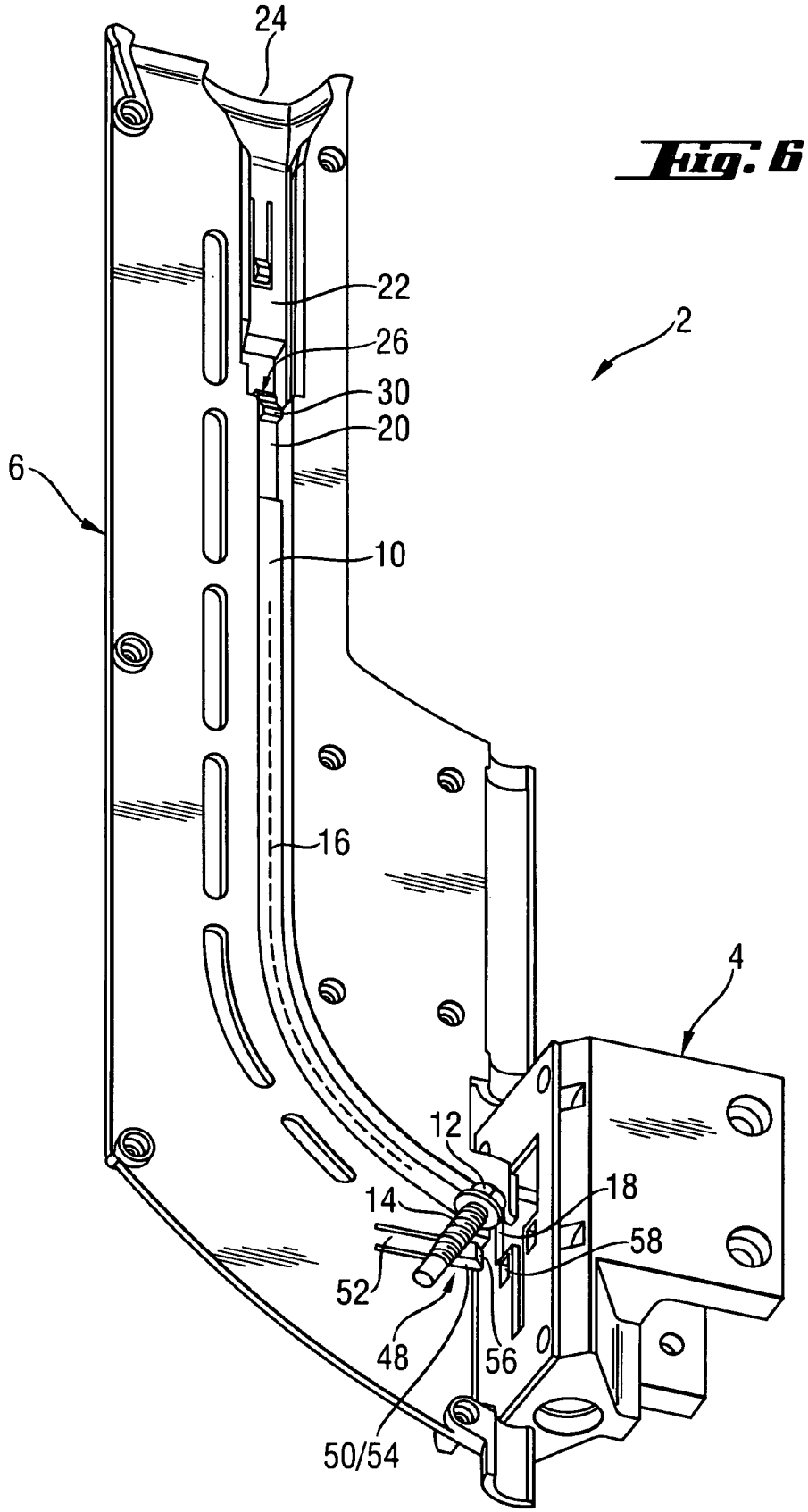
FIG. 6 shows a view of an inner side of the fastener guide and a connection part of the drive-in device at a connection area in the disconnected state according to the invention.
Figure 7:
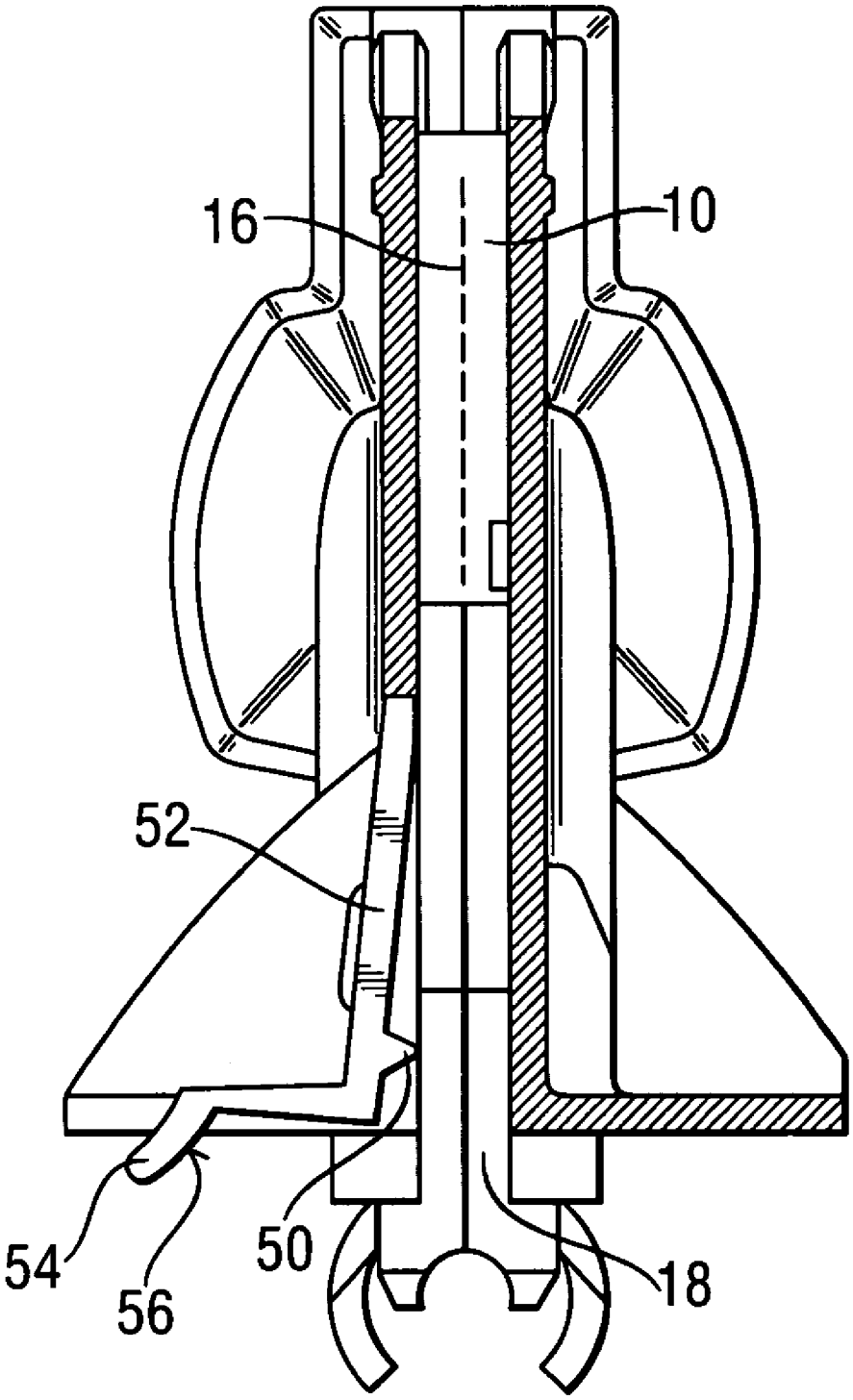
FIG. 7 shows a cross section through a second fall-out prevention device in the open position as an alternative to FIG. 6.

This filling can accordingly be carried out when the fastener guide 6 is mounted at the drive in device 4 as well as when the fastener guide 6 is detached from the drive in device 4. In order to prevent fasteners 14 from falling out in an unwanted manner in the detached state of the fastener guide 16, this fastener guide 6 has a second fall-out prevention device 48 at the opening 18 of the guide path 16 on the device side as is shown in FIGS. 6 and 7. A second blocking element 50 is formed at a second spring arm 52 of this second fall-out prevention device 48. The spring arm 52 has, at its movable end, an actuating element 54 that forms a sloping or curved contact surface 56. In the unloaded state of the spring arm 52, i.e., when the fastener guide 6 is detached from the drive in device 4, the second blocking element 50 projects into the guide path 16 and accordingly prevents fasteners 14 held therein from slipping out (see FIG. 6). In the embodiment shown in FIG. 6, the blocking element 50 and the actuating element 54 forming the contact surface 56 coincide.

A deflecting element 58 in the form of a housing recess is formed at the drive in device 4 (see FIG. 6). When the fastener guide 6 is mounted at the drive in device 4, the actuating element 54 engages in the deflecting element 58. In so doing, the contact surface 56 comes in contact with the deflecting element 58 such that the spring arm 52 is pressed toward the side. The second blocking element 50 is accordingly moved out of the guide path 16.

This open position of the second fall-out prevention device 48 is shown in FIG. 7 for an alternative embodiment to the embodiment shown in FIG. 6, in which the actuating element 54 is shaped out at a distance from the blocking element 50. In this position of the second fall-out prevention device 48, fasteners 14 guided in the fastener guide 6 can now slide into the drive in device 4 for mounting.

It will be noted that the first fall-out prevention device 26, the second fall-out prevention device 48 and the magazine strip opening device 34 are each constructed in pairs, although only one of each is shown for reasons pertaining to the illustrations.

What is claimed is:

1. A fastener guide (6) for use in a power-operated drive-in device (4) such as a stand-up tool (2), having a guide path (16) in which a plurality of fasteners (14) are received and having a device-side opening (18) and a free opening (20), the guide path (16) being curved toward the device-side opening (18) proceeding from the free opening (20), wherein the fastener guide (6) has connection means for detachable mounting at the drive-in device, and the guide path (16) has a fall-out prevention device (26, 48) at each of the two openings (18, 20).

2. The fastener guide (6) of claim 1, wherein at least one of the fall-out prevention devices (26, 48) has a blocking element (30, 50) which projects into the guide path (16) when not loaded.

3. The fastener guide (6) of claim 2, wherein the blocking element (30) of the fall-out prevention device (26) at the opening (18) on the device side is moved out of the guide path (16) when the fastener guide (6) is mounted to the drive-in device (4).

4. The fastener guide (6) of claim 3, wherein the fastener guide (16) has a magazine strip opening device (34) at one of the openings (18, 20).

5. The fastener guide (6) of claim 4, wherein the magazine strip opening device (34) has a deflecting device (36) which projects into a magazine strip receptacle (22) and deflects at least one wall (45, 47) of the magazine strip (42) away from the rest of the magazine strips (42) when a magazine strip (42) is inserted into the magazine strip receptacle (22).

6. The fastener guide (6) of claim 5, wherein the fall-out prevention device (26, 48) of the opening (18, 20) at which the magazine strip opening device (34) is arranged has a spring arm (28, 52) that is actuated by the deflected wall (45, 47).

7. The fastener guide (6) of claim 6, wherein the deflecting device (36) has at least one inclined area (40) inclining away from the magazine strip receptacle (22) in an insertion direction of the magazine strip (42) toward an inner side of the spring arm (28, 52).

8. The fastener guide (6) of claim 7, wherein the blocking element (3, 50) is shaped at the inner side of the spring arm (28, 52) and has a sloping contact surface (32) in a direction of the magazine strip receptacle (22).

9. The fastener guide (6) of claim 4, wherein the magazine strip opening device (34) is arranged at the free opening (20).

10. A power-operated drive in device with a fastener guide such as a stand-up tool (2), having a guide path (16) in which a plurality of fasteners (14) are received and having a device-side opening (18) and a free opening (20), the guide path (16) being curved toward the device-side opening (18) proceeding from the free opening (20), wherein the fastener guide (6) has connection means for detachable mounting at the drive-in device, and the guide path (16) has a fall-out prevention device (26, 48) at each of the two openings (18, 20), and wherein the drive-in device has connection means at which the connection means of the fastener guide can be arranged.

11. The power-operated drive-in device of claim 10, wherein the spring arm (52) of the fall-out prevention device (48) at the device-side opening (18) has an actuating element (54) which is swiveled by a deflecting element (58) formed at the drive-in device (4) when the fastener guide (6) is mounted.

* * * * *